US012188200B2

(12) United States Patent
Okuwaki et al.

(10) Patent No.: US 12,188,200 B2
(45) Date of Patent: Jan. 7, 2025

(54) CONTROL SYSTEM AND CONTROL METHOD

(71) Applicant: KOMATSU LTD., Tokyo (JP)

(72) Inventors: Ryuta Okuwaki, Tokyo (JP); Takeshi Oi, Tokyo (JP); Kenji Okamura, Tokyo (JP)

(73) Assignee: KOMATSU LTD., Tokyo (JP)

( * ) Notice: Subject to any disclaimer, the term of this patent is extended or adjusted under 35 U.S.C. 154(b) by 243 days.

(21) Appl. No.: 17/800,014

(22) PCT Filed: Apr. 16, 2021

(86) PCT No.: PCT/JP2021/015677
§ 371 (c)(1),
(2) Date: Aug. 16, 2022

(87) PCT Pub. No.: WO2021/210665
PCT Pub. Date: Oct. 21, 2021

(65) Prior Publication Data

US 2023/0074375 A1 Mar. 9, 2023

(30) Foreign Application Priority Data

Apr. 17, 2020 (JP) ..... 2020-074337

(51) Int. Cl.
*E02F 3/43* (2006.01)
*E02F 9/20* (2006.01)
(Continued)

(52) U.S. Cl.
CPC ..... *E02F 3/439* (2013.01); *E02F 3/437* (2013.01); *E02F 9/2033* (2013.01); *E02F 9/205* (2013.01); *E02F 9/24* (2013.01); *E02F 9/265* (2013.01)

(58) Field of Classification Search
CPC ..... E02F 3/437; E02F 3/439; E02F 9/2033; E02F 9/205; E02F 9/24; E02F 9/265
(Continued)

(56) References Cited

U.S. PATENT DOCUMENTS 4,795,305 A 1/1989 Friend
2008/0263908 A1* 10/2008 Schoenmaker ..... E02F 9/2041 711/100

(Continued)

FOREIGN PATENT DOCUMENTS

AU 2015202126 A1 11/2015
CA 860733 A 1/1971

(Continued)

OTHER PUBLICATIONS

Tao Lin-yu, Wang Jun, Cai Deng-sheng, Sun Jin-quan et al., Research on automatic bucket leveling algorithm of loader angular displacement system, Construction Machinery, Dec. 31, 2014,.

*Primary Examiner* — Atul Trivedi
(74) *Attorney, Agent, or Firm* — Global IP Counselors, LLP

(57) ABSTRACT

An automatic control determination unit determines whether to start automatic dumping control. A dumping control unit generates a first command to rotate a bucket in a dump direction until an inclination of the bucket reaches a predetermined dumping completion angle upon determining to start the automatic dumping control. The dumping control unit generates a second command to rotate a boom in a raising direction during a period until the inclination of the bucket reaches the dumping completion angle from an inclination at the time of start of the automatic dumping control.

13 Claims, 12 Drawing Sheets

(51) Int. Cl.
*E02F 9/24* (2006.01)
*E02F 9/26* (2006.01)

(58) Field of Classification Search
USPC ..... 701/50
See application file for complete search history.

(56) References Cited

U.S. PATENT DOCUMENTS

| | | | | |
|---|---|---|---|---|
| 2008/0263910 | A1* | 10/2008 | Schoenmaker | E02F 9/264 711/100 |
| 2010/0204891 | A1* | 8/2010 | Biggerstaff | E02F 9/2033 701/50 |
| 2014/0039767 | A1* | 2/2014 | Jensen | B60K 23/0808 701/50 |
| 2016/0076228 | A1* | 3/2016 | Nau | E02F 3/842 701/50 |
| 2018/0119384 | A1 | 5/2018 | Imaizumi et al. | |
| 2019/0033158 | A1* | 1/2019 | Bonnet | G01L 5/0061 |
| 2020/0024828 | A1 | 1/2020 | Asada et al. | |
| 2020/0071908 | A1* | 3/2020 | Cherney | B60W 10/20 |
| 2020/0087893 | A1* | 3/2020 | Hageman | E02F 9/268 |
| 2020/0199853 | A1 | 6/2020 | Konda et al. | |
| 2020/0224385 | A1 | 7/2020 | Saigo et al. | |
| 2021/0071390 | A1* | 3/2021 | Kean | E02F 9/2029 |
| 2021/0148082 | A1* | 5/2021 | Suzuki | E02F 9/265 |
| 2021/0246625 | A1 | 8/2021 | Oi et al. | |
| 2021/0262196 | A1* | 8/2021 | Ito | E02F 9/2282 |
| 2022/0178106 | A1* | 6/2022 | Kumagai | E02F 9/264 |
| 2022/0186461 | A1* | 6/2022 | Konda | E02F 9/205 |
| 2022/0205225 | A1* | 6/2022 | Shiratani | E02F 9/2282 |
| 2022/0412041 | A1* | 12/2022 | Konda | E02F 9/2235 |
| 2023/0339510 | A1* | 10/2023 | Hiranaka | E02F 9/205 |
| 2023/0340759 | A1* | 10/2023 | Bruflodt | G05D 1/0038 |
| 2024/0011252 | A1* | 1/2024 | Onodera | E02F 9/20 |
| 2024/0026653 | A1* | 1/2024 | Sano | E02F 9/123 |
| 2024/0035257 | A1* | 2/2024 | Umeda | E02F 9/262 |
| 2024/0167245 | A1* | 5/2024 | Sano | E02F 9/2033 |
| 2024/0175243 | A1* | 5/2024 | Nishimaki | E02F 3/651 |
| 2024/0209591 | A1* | 6/2024 | Honda | E02F 3/437 |
| 2024/0318402 | A1* | 9/2024 | Honda | E02F 3/32 |

FOREIGN PATENT DOCUMENTS

| | | | | |
|---|---|---|---|---|
| CA | 2980054 | A1 * | 3/2018 | E02F 3/437 |
| CN | 105040768 | A | 11/2015 | |
| CN | 116562438 | A * | 8/2023 | |
| CN | 117306614 | A * | 12/2023 | |
| DE | 19510374 | A1 * | 9/1995 | E02F 3/439 |
| DE | 19510634 | A1 * | 9/1995 | E02F 3/437 |
| EP | 1416095 | A1 * | 5/2004 | E02F 3/433 |
| EP | 1650358 | A2 * | 4/2006 | E02F 3/432 |
| EP | 1988220 | A2 * | 11/2008 | E02F 3/434 |
| EP | 1988220 | B1 * | 9/2012 | E02F 3/434 |
| EP | 3 779 070 | A1 | 2/2021 | |
| GB | 2488990 | A * | 9/2012 | E02F 3/3618 |
| JP | 52-149804 | A | 12/1977 | |
| JP | 6-257187 | A | 9/1994 | |
| JP | 6-280288 | A | 10/1994 | |
| JP | 10-46620 | A | 2/1998 | |
| JP | 10-88610 | A | 4/1998 | |
| JP | 10-212740 | A | 8/1998 | |
| JP | 11-124880 | A | 5/1999 | |
| JP | 2000-328596 | A | 11/2000 | |
| JP | 2001-303605 | A | 10/2001 | |
| JP | 2016-89388 | A | 5/2016 | |
| JP | 2016-89389 | A | 5/2016 | |
| JP | 2019-132064 | A | 8/2019 | |
| KR | 930021894 | A | 11/1993 | |
| WO | WO-2012169531 | A1 * | 12/2012 | B60P 1/045 |
| WO | WO-2014097688 | A1 * | 6/2014 | E02F 3/32 |
| WO | WO-2014097689 | A1 * | 6/2014 | E02F 3/32 |
| WO | WO-2016158255 | A1 * | 10/2016 | E02F 9/24 |
| WO | WO-2016159012 | A1 * | 10/2016 | B60R 1/00 |
| WO | WO-2017010212 | A1 * | 1/2017 | E02F 3/437 |
| WO | 2017/126182 | A1 | 7/2017 | |
| WO | 2019/069947 | A1 | 4/2019 | |
| WO | WO-2019131979 | A1 * | 7/2019 | E02F 3/43 |
| WO | WO-2019131980 | A1 * | 7/2019 | E02F 3/435 |
| WO | WO-2019139102 | A1 * | 7/2019 | B66C 1/68 |
| WO | WO-2019162201 | A1 * | 8/2019 | B65G 43/08 |
| WO | 2019/189013 | A1 | 10/2019 | |
| WO | WO-2019189030 | A1 * | 10/2019 | E02F 3/431 |
| WO | WO-2019189031 | A1 * | 10/2019 | E02F 9/128 |
| WO | WO-2019189203 | A1 * | 10/2019 | B60R 1/00 |
| WO | WO-2019189939 | A1 * | 10/2019 | E02F 3/435 |
| WO | WO-2019207981 | A1 * | 10/2019 | E02F 3/434 |
| WO | 2020/044842 | A1 | 3/2020 | |
| WO | WO-2020049623 | A1 * | 3/2020 | E02F 3/431 |
| WO | WO-2020255635 | A1 * | 12/2020 | E02F 3/43 |
| WO | WO-2022210613 | A1 * | 10/2022 | E02F 3/435 |
| WO | WO-2022210619 | A1 * | 10/2022 | E02F 3/302 |

* cited by examiner

CONTROL SYSTEM AND CONTROL METHOD

CROSS-REFERENCE TO RELATED APPLICATIONS

This application is a U.S. National stage application of International Application No. PCT/JP2021/015677, filed on Apr. 16, 2021. This U.S. National stage application claims priority under 35 U.S.C. § 119(a) to Japanese Patent Application No. 2020-074337, filed in Japan on Apr. 17, 2020, the entire contents of which are hereby incorporated herein by reference.

The present disclosure relates to a control device and a control method of a work system.

Priority is claimed on Japanese Patent Application No. 2020-074337, filed Apr. 17, 2020, the content of which is incorporated herein by reference.

BACKGROUND INFORMATION

Japanese Unexamined Patent Application, First Publication No. 2019-132064 discloses a technique relating to automatic loading control of a work machine. The work machine described in Japanese Unexamined Patent Application, First Publication No. 2019-132064 automatically performs hoist swing control while preventing a bucket from coming into contact with a transport vehicle, and then dumps an excavation object.

SUMMARY

The work machine described in Japanese Unexamined Patent Application, First Publication No. 2019-132064 dumps the excavation object by rotating the bucket in a dump direction. In general, the point farthest from a bucket pin in an outer shape of the bucket is teeth, and therefore, when the bucket is rotated in the dump direction, the lowest point of the bucket is lowered. Therefore, in the work machine described in Japanese Unexamined Patent Application, First Publication No. 2019-132064, it is necessary to dump the excavation object from a high position in consideration of a locus of the lowest point of the bucket by rotation. The higher the dumping position, the higher the possibility of the excavation object spilling from the transport vehicle. If there are many spills of the excavation object, a scaffolding around a target stop position of the transport vehicle becomes rough, so that the transport vehicle becomes difficult to stop.

An object of the present disclosure is to provide a control system and a control method capable of realizing dumping at a low position in automatic dumping control.

According to one aspect, there is provided a control system for a work machine that includes a work machine main body, a boom rotatably mounted to the work machine main body, an arm rotatably mounted to a tip of the boom, and a bucket rotatably mounted to a tip of the arm, and includes: an automatic control determination unit configured to determine whether or not to start automatic dumping control; a bucket control unit configured to generate a first command to rotate the bucket in a dump direction until an inclination of the bucket reaches a predetermined dumping completion angle in a case where it is determined to start the automatic dumping control; and a boom control unit configured to generate a second command to rotate the boom in a raising direction during a period until the inclination of the bucket reaches the dumping completion angle from an inclination at the time of start of the automatic dumping control according to the first command.

According to the above aspect, the control system can suppress lowering of the lowest point of a bucket in automatic dumping control.

DESCRIPTION OF EMBODIMENTS

First Embodiment

<<Work System 1>>

Figure 1:
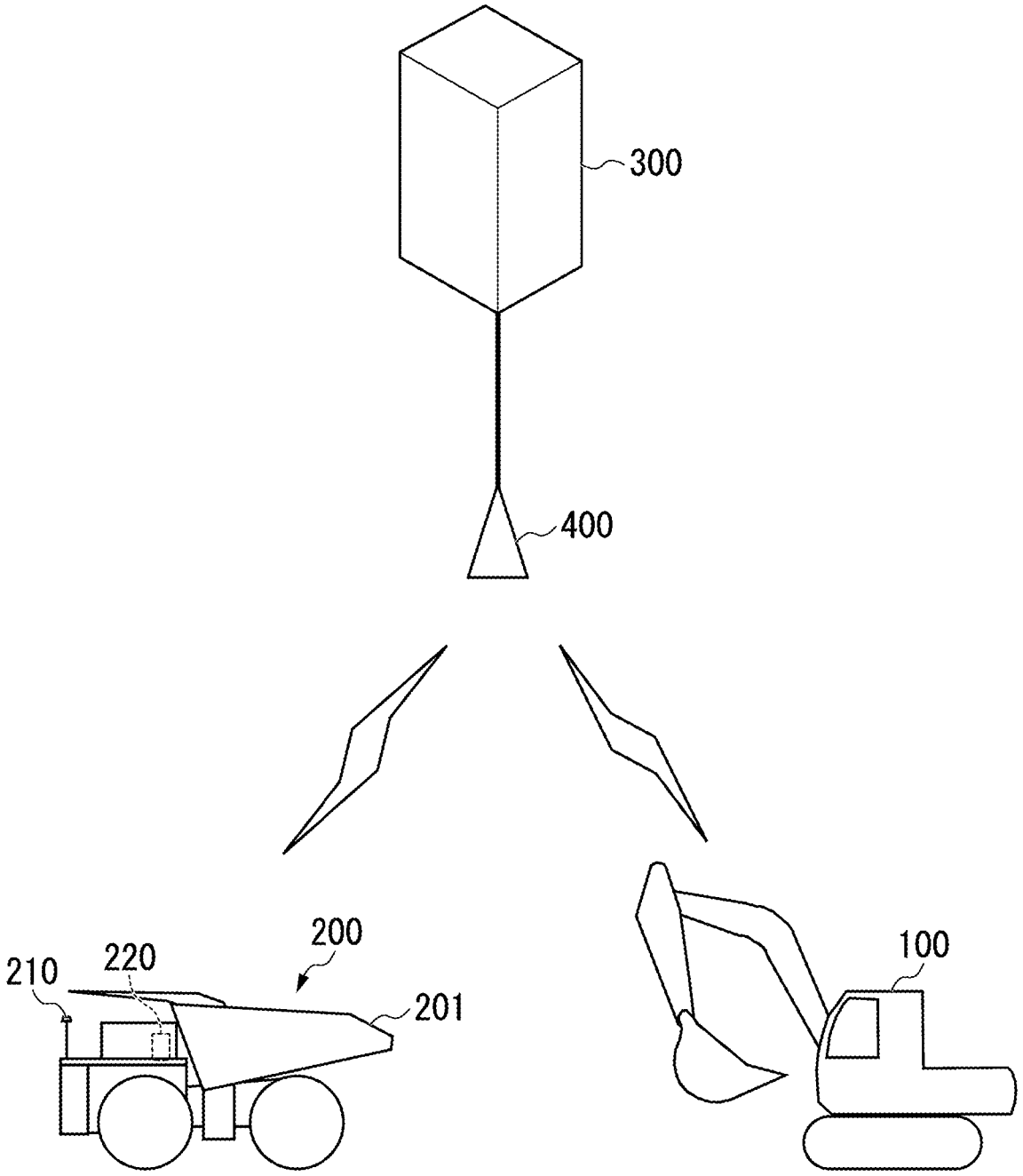
FIG. 1 is a schematic view showing a configuration of a work system according to a first embodiment.

FIG. 1 is a schematic view showing a configuration of a work system according to a first embodiment.

A work system 1 includes a work machine 100, one or a plurality of transport vehicles 200, and a controlling gear 300. The work system 1 is an unmanned transport system that automatically controls the work machine 100 and the transport vehicle 200 by the controlling gear 300.

The transport vehicle 200 travels in an unmanned manner, based on course data (for example, speed data, and coordinates for which the transport vehicle 200 is to head) that is received from the controlling gear 300. The transport vehicle 200 and the controlling gear 300 are connected to each other by communication via an access point 400. The controlling gear 300 acquires a position and an azimuth direction from the transport vehicle 200 and generates course data that is used in the traveling of the transport vehicle 200, based on the position and the azimuth direction. The controlling gear 300 transmits the course data to the transport vehicle 200. The transport vehicle 200 travels in an unmanned manner, based on the received course data. The work system 1 according to the first embodiment includes an unmanned transport system, but some or all of the transport vehicles 200 may be operated in a manned manner in another embodiment. In this case, the controlling gear 300 does not need to perform transmission of the course data and an instruction regarding loading, but the controlling gear 300 acquires the position and azimuth direction of the transport vehicle 200.

The work machine 100 is controlled in an unmanned manner according to an instruction that is received from the controlling gear 300. The work machine 100 and the controlling gear 300 are connected to each other by communication via the access point 400.

The work machine 100 and the transport vehicle 200 are provided at a work site (for example, a mine or a quarry). The controlling gear 300 may be provided at any place. For example, the controlling gear 300 may be provided at a point (for example, in a city or a work site) away from the work machine 100 and the transport vehicle 200.

<<Transport Vehicle 200>>

The transport vehicle 200 according to the first embodiment is a dump truck provided with a dump body 201. The transport vehicle 200 according to another embodiment may be a transport vehicle other than a dump truck.

The transport vehicle 200 includes the dump body 201, a position and azimuth direction calculator 210, and a control device 220. The position and azimuth direction calculator 210 calculates a position of the transport vehicle 200 and an azimuth direction of the transport vehicle 200. The position and azimuth direction calculator 210 includes two receivers that receive positioning signals from an artificial satellites configuring Global Navigation Satellite System (GNSS). An example of GNSS is the Global Positioning System (GPS). The two receivers are installed at positions different from each other on the transport vehicle 200. The position and azimuth direction calculator 210 detects the position of the transport vehicle 200 in a site coordinate system, based on the positioning signals received by the receivers. The position and azimuth direction calculator 210 uses the respective positioning signals received by the two receivers to calculate an azimuth direction in which the transport vehicle 200 faces, as a relationship between the installation position of one receiver and the installation position of the other receiver. In another embodiment, there is no limitation to this, and for example, the transport vehicle 200 may include an inertial measurement unit (IMU), and an azimuth direction may be calculated based on the measurement result of the inertial measurement unit. In this case, the drift of the inertial measurement unit may be corrected based on a traveling trajectory of the transport vehicle 200.

The control device 220 transmits the detected position and the calculated azimuth direction by the position and azimuth direction calculator 210 to the controlling gear 300. The control device 220 receives, from the controlling gear 300, the course data, a dumping instruction, an accessing instruction to a loading point P3, and a departure instruction from the loading point P3. The control device 220 causes the transport vehicle 200 to travel according to the received course data, or moves the dump body 201 of the transport vehicle 200 up and down according to the dumping instruction. When the transport vehicle arrives at the destination and stops based on the instruction, the control device 220 transmits an arrival notification indicating the arrival at the destination (for example, the loading point P3 shown in FIG. 4) to the controlling gear 300.

<<Work Machine 100>>

Figure 2:
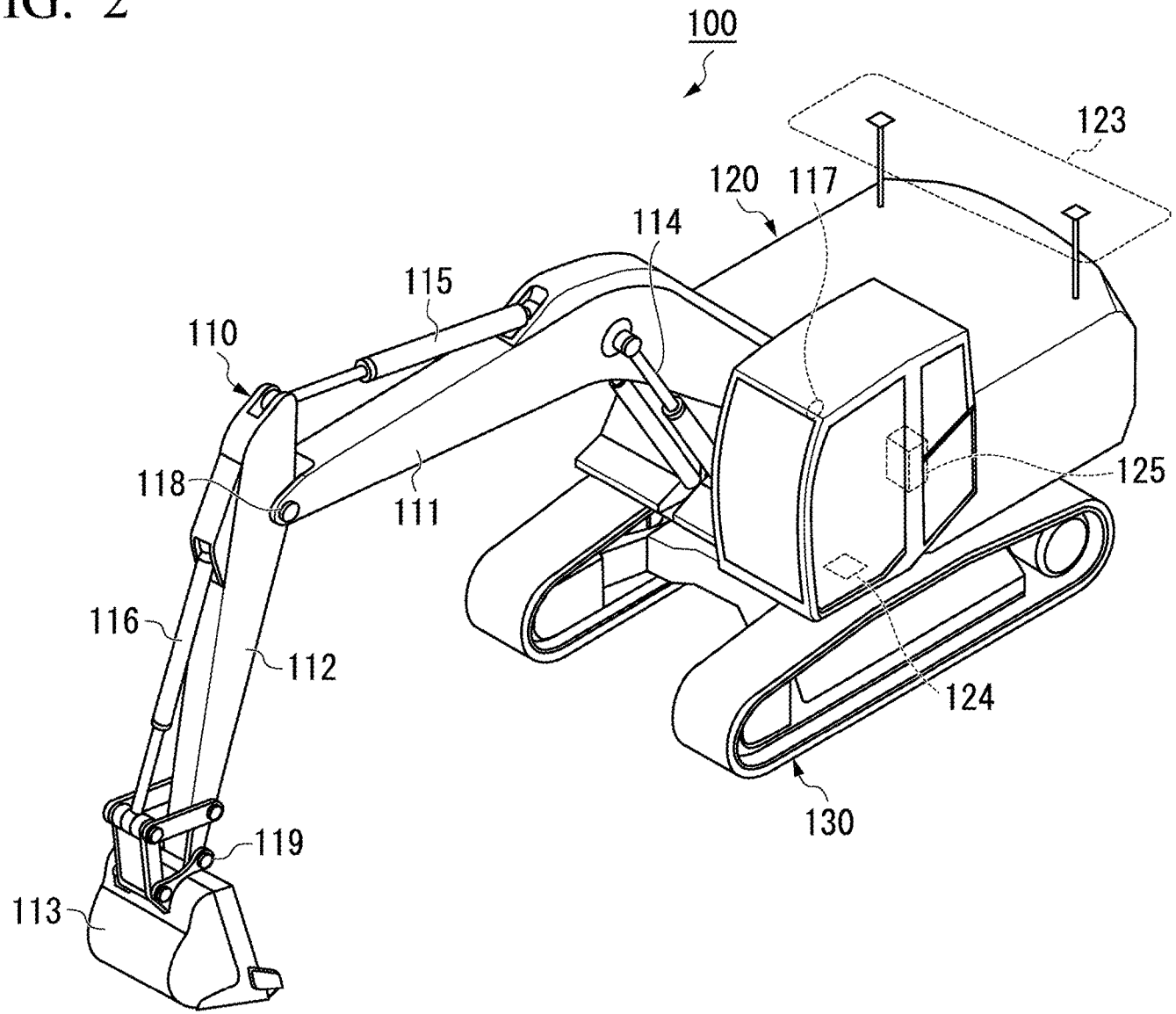
FIG. 2 is an external view of a work machine according to the first embodiment.

FIG. 2 is an external view of the work machine 100 according to the first embodiment.

The work machine 100 according to the first embodiment is a hydraulic excavator. The work machine 100 according to another embodiment may be a work vehicle other than a hydraulic excavator.

The work machine 100 includes work equipment 110 that is hydraulically operated, a swing body 120 that supports the work equipment 110, and a travel body 130 that supports the swing body 120.

The work equipment 110 includes a boom 111, an arm 112, a bucket 113, a boom cylinder 114, an arm cylinder 115, a bucket cylinder 116, a boom angle sensor 117, an arm angle sensor 118, and a bucket angle sensor 119.

A base end portion of the boom 111 is mounted to a front portion of the swing body 120 through a pin.

The arm 112 connects the boom 111 and the bucket 113. A base end portion of the arm 112 is mounted to a tip portion of the boom 111 through a pin.

The bucket 113 includes an edge for excavating an excavation object such as earth, and a container for transporting the excavation object. A base end portion of the bucket 113 is mounted to a tip portion of the arm 112 through a pin. Examples of the excavation object include earth, ore, crushed stone, coal, and the like.

The boom cylinder 114 is a hydraulic cylinder for operating the boom 111. A base end portion of the boom cylinder 114 is mounted to the swing body 120. A tip portion of the boom cylinder 114 is mounted to the boom 111.

The arm cylinder 115 is a hydraulic cylinder for driving the arm 112. A base end portion of the arm cylinder 115 is mounted to the boom 111. A tip portion of the arm cylinder 115 is mounted to the arm 112.

The bucket cylinder 116 is a hydraulic cylinder for driving the bucket 113. A base end portion of the bucket cylinder 116 is mounted to the arm 112. A tip portion of the bucket cylinder 116 is mounted to the bucket 113.

The boom angle sensor 117 is mounted to the boom 111 and detects an inclination angle of the boom 111.

The arm angle sensor 118 is mounted to the arm 112 and detects an inclination angle of the arm 112.

The bucket angle sensor 119 is mounted to the bucket 113 and detects an inclination angle of the bucket 113.

The boom angle sensor 117, the arm angle sensor 118, and the bucket angle sensor 119 according to the first embodiment detect an inclination angle with respect to a horizon plane. An angle sensor according to another embodiment is not limited to this and may detect an inclination angle with respect to another reference plane. For example, in another embodiment, an angle sensor may detect a relative angle with a mounting part as a reference or may detect an inclination angle by measuring a stroke of each cylinder and converting the stroke of the cylinder into an angle.

The work machine 100 includes a position and azimuth direction calculator 123, an inclination measuring instrument 124, and a control device 125.

The position and azimuth direction calculator 123 calculates a position of the swing body 120 and an azimuth direction in which the swing body 120 faces. The position and azimuth direction calculator 123 includes two receivers that receive positioning signals from an artificial satellite configuring GNSS. The two receivers are installed at positions different from each on the swing body 120. The position and azimuth direction calculator 123 detects a position of a representative point of the swing body 120 (for example, a swing center of the swing body 120) in the site coordinate system, based on the positioning signal received by one receiver.

The position and azimuth direction calculator 123 uses the respective positioning signals received by the two receivers to calculate an azimuth direction in which the swing body 120 faces, as a relationship between the installation position of one receiver and the installation position of the other receiver. The control device 125 can convert a position in the site coordinate system to a position in a machine coordinate system and vice versa by using the position of the representative point of the swing body 120 in the site coordinate system. The machine coordinate system is an orthogonal coordinate system with the representative point of the swing body 120 as a reference.

The inclination measuring instrument 124 measures the acceleration and angular velocity of the swing body 120, and detects a posture (for example, a roll angle, a pitch angle, or a yaw angle) of the swing body 120, based on the measurement result. The inclination measuring instrument 124 is installed, for example, on a lower surface of the swing body 120. As the inclination measuring instrument 124, for example, an inertial measurement unit (IMU) can be used.

The control device 125 transmits the swinging speed, position, and azimuth direction of the swing body 120, the inclination angles of the boom 111, the arm 112, and the bucket 113, the traveling speed of the travel body 130, and the posture of the swing body 120 to the controlling gear 300. Hereinafter, data collected from various sensors by the work machine 100 or the transport vehicle 200 is also referred to as vehicle data. Vehicle data according to another embodiment is not limited to this. For example, vehicle data according to another embodiment may not include the swinging speed, the position, the azimuth direction, the inclination angle, the traveling speed, or the posture, may include a value detected by another sensor, or may include a value calculated from the detected value.

The control device 125 receives a control instruction from the controlling gear 300. The control device 125 drives the work equipment 110, the swing body 120, or the travel body 130 according to the received control instruction. When the driving based on the control instruction is completed, the control device 125 transmits a completion notification of the automatic excavation and loading control to the controlling gear 300. The detailed configuration of the control device 125 will be described later.

<<Controlling Gear 300>>

Figure 3:
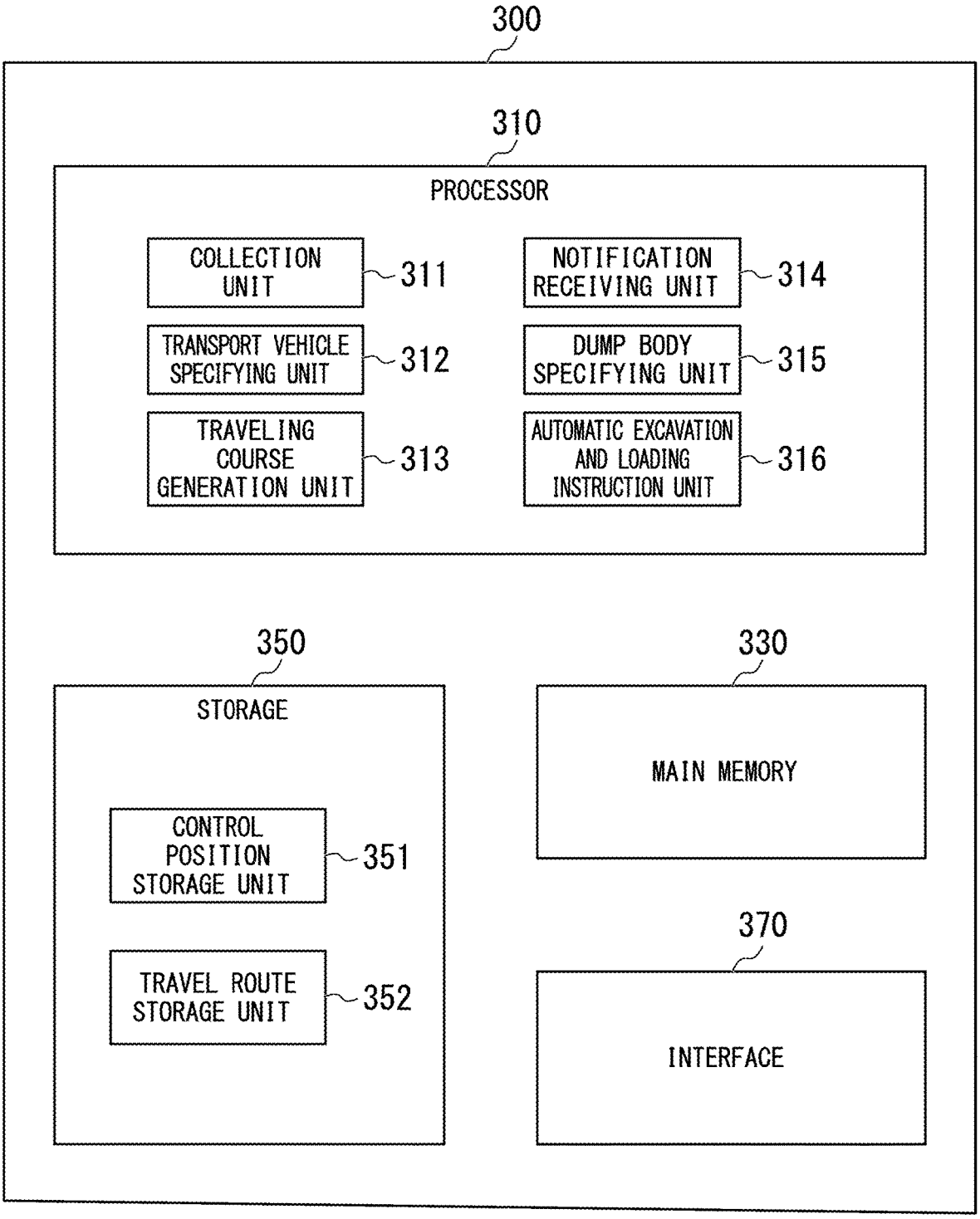
FIG. 3 is a schematic block diagram showing a configuration of a controlling gear according to the first embodiment.

FIG. 3 is a schematic block diagram showing the configuration of the controlling gear 300 according to the first embodiment.

The controlling gear 300 manages the operation of the work machine 100 and the traveling of the transport vehicle 200.

The controlling gear 300 is a computer that includes a processor 310, a main memory 330, a storage 350, and an interface 370. The storage 350 stores a program. The processor 310 reads out the program from the storage 350 to load the program in the main memory 330 and executes processing according to the program. The controlling gear 300 is connected to a network through the interface 370. Examples of the processor 310 include a Central Processing Unit (CPU), a Graphic Processing Unit (GPU), and a microprocessor.

The program may realize some of functions to be exhibited by the computer of the controlling gear 300. For example, the program may exhibit functions in combination with another program that is already stored in the storage or in combination with another program installed in another device. In another embodiment, the controlling gear 300 may include a custom large scale integrated circuit (LSI) such as a programmable logic device (PLD) in addition to the above configuration or instead of the above configuration. Examples of the PLD include a programmable array logic (PAL), a generic array logic (GAL), a complex programmable logic device (CPLD), and a field programmable gate array (FPGA). In this case, some or all of the functions to be realized by the processor 310 may be realized by the integrated circuit. Such an integrated circuit is also included as an example of the processor.

The storage 350 has storage areas as a control position storage unit 351 and a travel route storage unit 352. Examples of the storage 350 include a magnetic disk, a magneto-optical disk, an optical disk, and a semiconductor memory. The storage 350 may be an internal medium directly connected to a common communication line of the controlling gear 300 or may be an external medium that is connected to the controlling gear 300 through the interface 370. The storage 350 is a non-transitory tangible storage medium.

The control position storage unit 351 stores position data of an excavation point P22 (refer to FIG. 6) and the loading point P3. The excavation point P22 and the loading point P3 are points that are set in advance by, for example, an operation by a manager or the like at the work site. The position data of the excavation point P22 and the loading point P3 that are stored in the control position storage unit 351 may be updated by the manager or the like according to the progress of the work, or the like.

Figure 4:
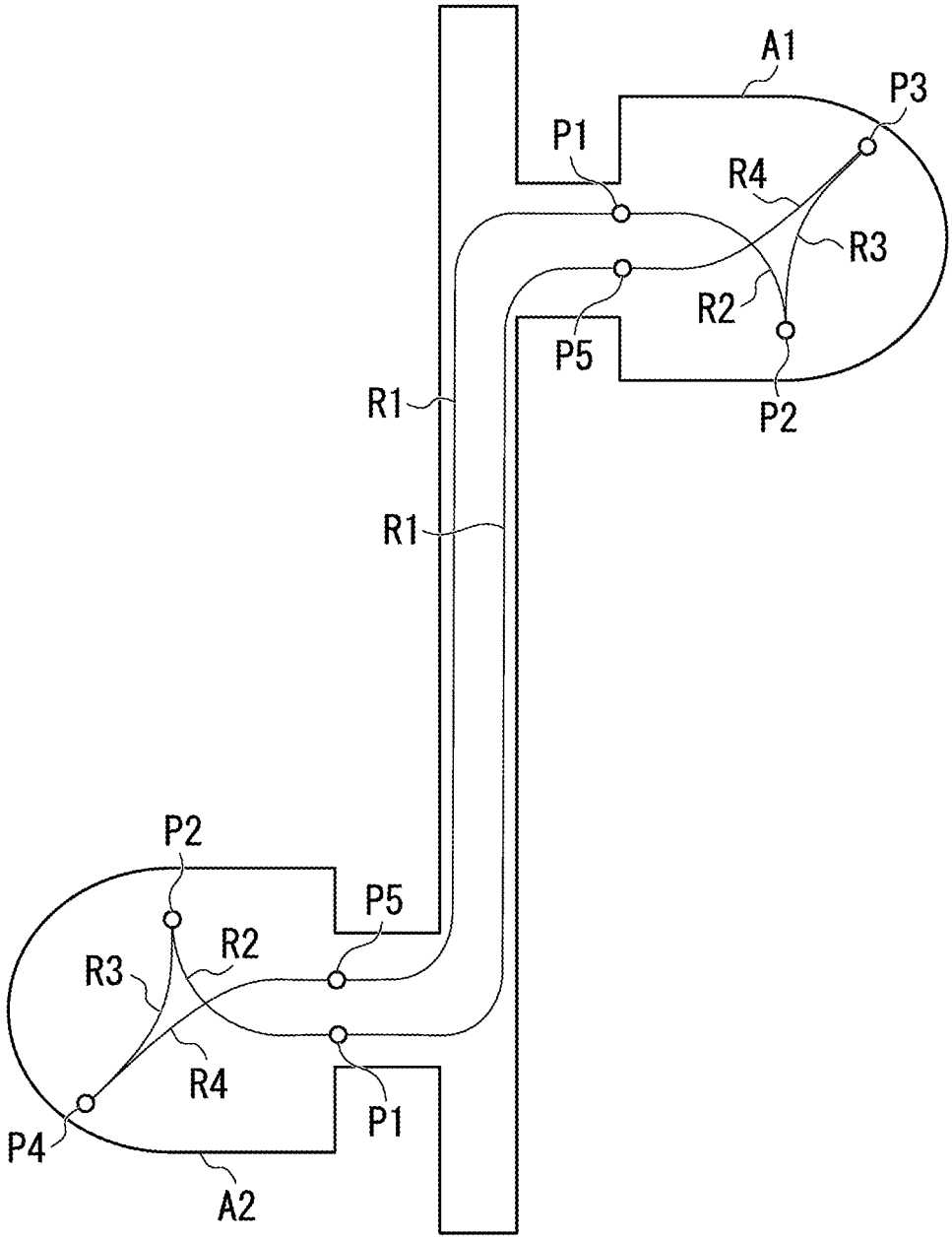
FIG. 4 is a diagram showing an example of a travel route.

FIG. 4 is a diagram showing an example of a travel route.

The travel route storage unit 352 stores a travel route R for each transport vehicle 200. The travel route R includes a connection route R1 that connects two areas A (for example, a loading site A1 and a dumping site A2) to each other and is determined in advance, and an access route R2, an approach route R3, and an exit route R4 that are routes in the area A. The access route R2 is a route that connects a standby point P1, which is one end of the connection route R1, and a predetermined turning point P2 to each other in the area A. The approach route R3 is a route that connects the turning point P2 and the loading point P3 or a dumping point P4 to each other in the area A. The exit route R4 is a route that connects the loading point P3 or the dumping point P4 and an exit point P5, which is the other end of the connection route R1, to each other in the area A. The turning point P2 is a point that is set by the controlling gear 300 according to the position of the loading point P3. The controlling gear 300 calculates the access route R2, the approach route R3, and the exit route R4 each time the loading point P3 is changed.

By the execution of the program, the processor 310 includes a collection unit 311, a transport vehicle specifying unit 312, a traveling course generation unit 313, a notification receiving unit 314, a dump body specifying unit 315, and an automatic excavation and loading instruction unit 316.

The collection unit 311 collects vehicle data from the work machine 100 and the transport vehicle 200 through the access point 400.

The transport vehicle specifying unit 312 specifies the transport vehicle 200 as a target vehicle on which the excavation object is to be loaded based on the vehicle data of the transport vehicle 200 collected by the collection unit 311.

The traveling course generation unit 313 generates course data indicating an area in which the movement of the transport vehicle 200 is allowed based on the travel route stored in the travel route storage unit 352 and the vehicle data collected by the collection unit 311, and transmits the course data to the transport vehicle 200. The course data is, for example, data representing an area in which the transport vehicle 200 can travel at a predetermined speed within a certain period of time and which does not overlap a travel route of another transport vehicle 200.

The notification receiving unit 314 receives a completion notification of the automatic excavation and loading control from the work machine 100 and receives the arrival notification at the loading point P3 from the transport vehicle 200.

When receiving the arrival notification at the loading point P3 from the transport vehicle 200, the dump body specifying unit 315 specifies the position of the dump body 201 in the site coordinate system, based on the vehicle data of the transport vehicle 200. For example, the dump body specifying unit 315 specifies a center position of a bottom surface of the dump body 201. The dump body specifying unit 315 specifies the position of the dump body 201, for example, by the following procedure. The dump body specifying unit 315 disposes three-dimensional data representing the shape of the transport vehicle 200 that includes the dump body 201 at a position that is indicated by the position data of the transport vehicle 200 such that the bottom surface of the dump body 201 faces upward. The dump body specifying unit 315 rotates the three-dimensional data in a direction that is indicated by the azimuth direction data of the transport vehicle 200, thereby specifying the position of the dump body 201 in the site coordinate system. The dump body specifying unit 315 transmits the specified position of the dump body 201 to the work machine 100.

The automatic excavation and loading instruction unit 316 transmits an automatic excavation and loading instruction that includes the position of the excavation point P22 and the position of the loading point P3 stored in the control position storage unit 351 to the work machine 100.

<<Control Device 125 of Work Machine>>

Figure 5:
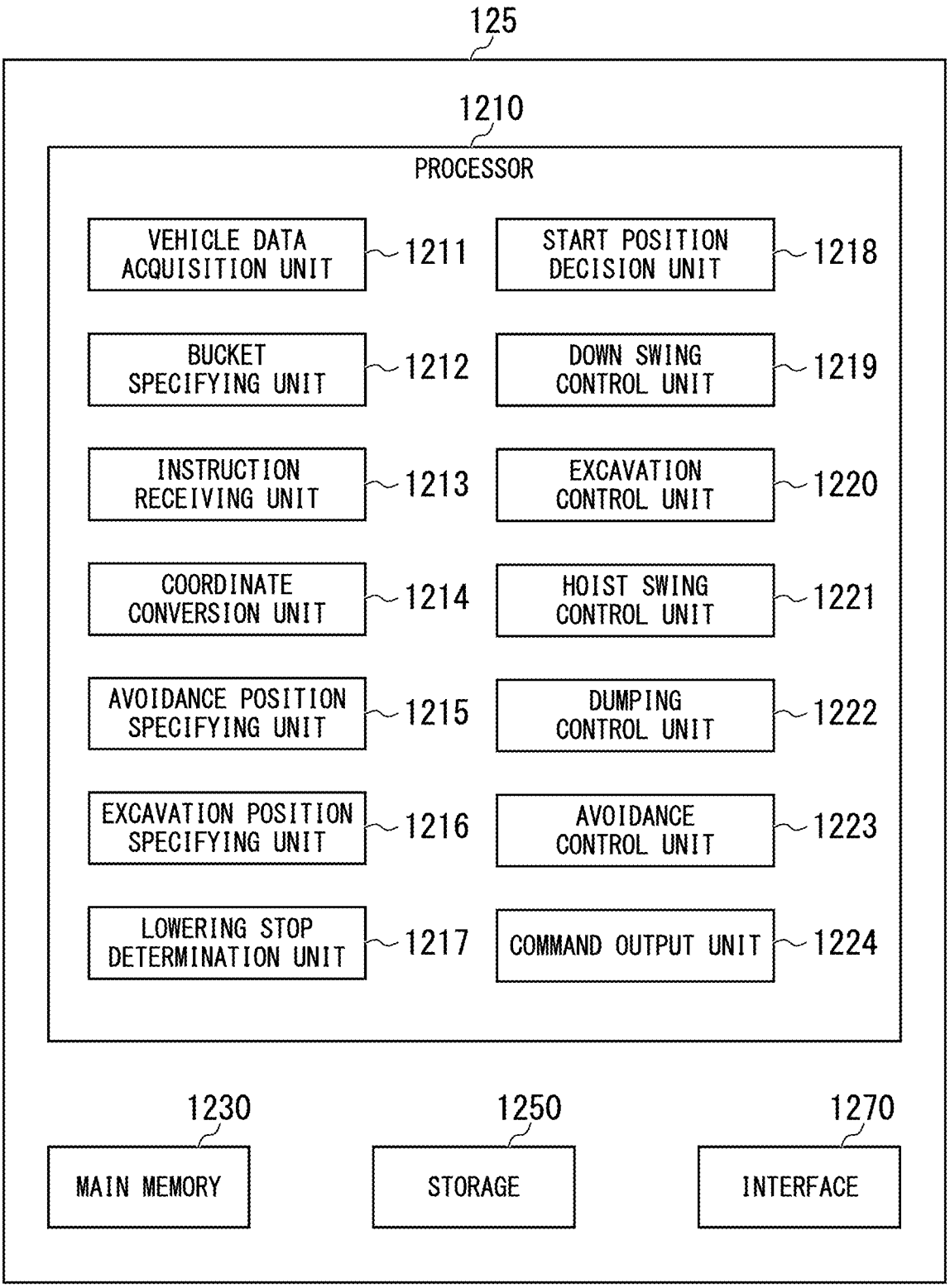
FIG. 5 is a schematic block diagram showing a configuration of a control device of the work machine according to the first embodiment.

FIG. 5 is a schematic block diagram showing the configuration of the control device 125 of the work machine according to the first embodiment.

The control device 125 controls an actuator of the work machine 100, based on the instruction of the controlling gear 300.

The control device 125 is a computer that includes a processor 1210, a main memory 1230, a storage 1250, and an interface 1270. The storage 1250 stores a program. The processor 1210 reads out the program from the storage 1250 to load the program in the main memory 1230 and executes processing according to the program. The control device 125 is connected to a network through the interface 1270. Examples of the processor 1210 include a Central Processing Unit (CPU), a Graphic Processing Unit (GPU), and a microprocessor.

The program may realize some of functions to be exhibited by the computer of the control device 125. For example, the program may exhibit functions in combination with another program that is already stored in the storage or in combination with another program installed in another device. In another embodiment, the control device 125 may include a custom LSI such as a PLD in addition to the above configuration or instead of the above configuration. In this case, some or all of the functions to be realized by the processor 1210 may be realized by the integrated circuit. Such an integrated circuit is also included as an example of the processor.

Examples of the storage 1250 include a magnetic disk, a magneto-optical disk, an optical disk, and a semiconductor memory. The storage 1250 may be an internal medium directly connected to a common communication line of the control device 125 or may be an external medium connected to the control device 125 via the interface 1270. The storage 1250 is a non-transitory tangible storage medium.

By the execution of the program, the processor 1210 includes a vehicle data acquisition unit 1211, a bucket specifying unit 1212, an instruction receiving unit 1213, a coordinate conversion unit 1214, an avoidance position specifying unit 1215, an excavation position specifying unit 1216, a lowering stop determination unit 1217, a start position decision unit 1218, a down swing control unit 1219, an excavation control unit 1220, a hoist swing control unit 1221, an dumping control unit 1222, an avoidance control unit 1223, and a command output unit 1224.

The vehicle data acquisition unit 1211 acquires the vehicle data from various sensors included in the work machine 100, and transmits the acquired vehicle data to the controlling gear 300.

The bucket specifying unit 1212 specifies the position of the bucket 113 in the machine coordinate system with the work machine 100 as a reference, based on the vehicle data acquired by the vehicle data acquisition unit 1211. The bucket specifying unit 1212 specifies positions of a plurality of points on the contour of the bucket 113 including teeth and a bottom portion of the bucket 113. The contour of the bucket 113 is a line that separates different surfaces (for example, a side surface, a bottom surface, and the like) of the shape of the bucket 113 from each other. The bucket specifying unit 1212 specifies at least the positions of a plurality of points on the contour of the bucket 113 when the bucket 113 is viewed from a side.

Specifically, the bucket specifying unit 1212 specifies the positions of the plurality of points on the contour of the bucket 113 by the following procedure. The bucket specifying unit 1212 obtains the position of the tip portion of the boom 111, based on an absolute angle of the boom 111 that is obtained from the inclination angle of the boom 111 and the known length (the distance from the pin at the base end portion to the pin at the tip portion) of the boom 111. The bucket specifying unit 1212 obtains an absolute angle of the arm 112, based on the absolute angle of the boom 111 and the inclination angle of the arm 112. The bucket specifying unit 1212 obtains the position of the tip portion of the arm 112, based on the position of the tip portion of the boom 111, the absolute angle of the arm 112, and the known length (the distance from the pin at the base end portion to the pin at the tip portion) of the arm 112.

The bucket specifying unit 1212 obtains an absolute angle of the bucket 113, based on the absolute angle of the arm 112 and the inclination angle of the bucket 113. The bucket specifying unit 1212 obtains the positions of the plurality of points on the contour of the bucket 113, based on the position of the tip portion of the arm 112, the absolute angle of the bucket 113, and the distances from the pin of the bucket 113 to the plurality of points on the contour of the bucket 113.

The instruction receiving unit 1213 receives the automatic excavation and loading instruction from the controlling gear 300. The instruction receiving unit 1213 determines that the automatic excavation and loading control is started, with the reception of the automatic excavation and loading instruction. The automatic excavation and loading control includes automatic dumping control. That is, the instruction receiving unit 1213 is an example of an automatic control determination unit that determines whether or not to start the automatic dumping control.

The coordinate conversion unit 1214 receives the position of the dump body 201 of the transport vehicle 200 from the controlling gear 300 and converts the position of the dump body 201 from the site coordinate system to the machine coordinate system, based on the vehicle data acquired by the vehicle data acquisition unit 1211. The coordinate conversion unit 1214 is an example of a loading container specifying unit that specifies the position of the dump body 201 in the machine coordinate system.

Figure 6:
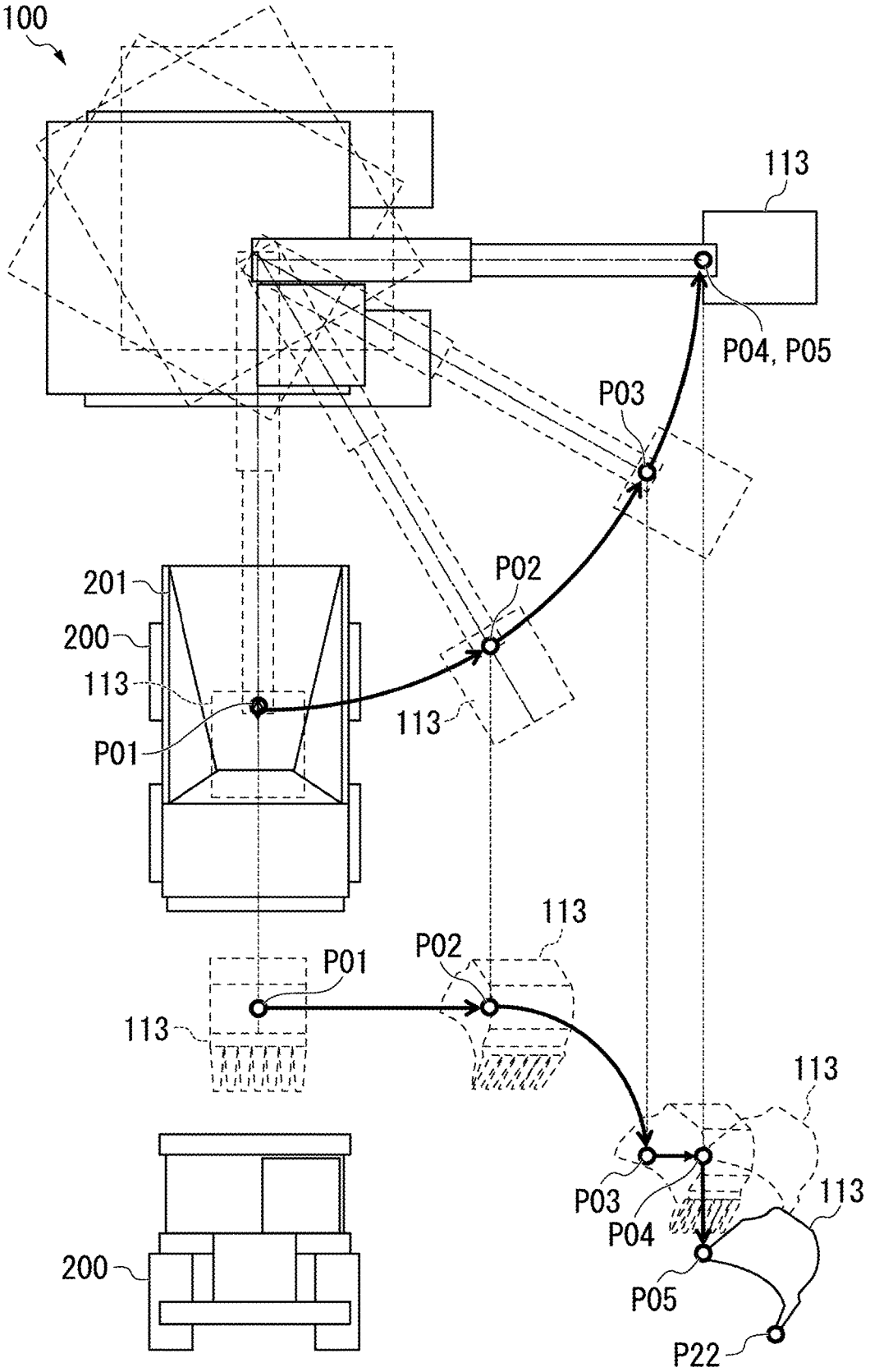
FIG. 6 is a diagram showing an example of a locus of a bucket before excavation in automatic excavation and loading control according to the first embodiment.

FIG. 6 is a diagram showing an example of the locus of the bucket before the excavation in the automatic excavation and loading control according to the first embodiment.

The avoidance position specifying unit 1215 specifies an interference avoidance position P02 which is a point where the work equipment 110 and the transport vehicle 200 do not interfere with each other when viewed in a plan view from above, based on the position of the work machine 100, the position of the dump body 201, and a position (a load-empty swing start position P01) of the pin of the bucket 113 at the time of start of the control. The interference avoidance position P02 is a position which has the same height as the load-empty swing start position P01, and in which the distance from the swing center of the swing body 120 to the interference avoidance position P02 is equal to the distance from the swing center of the swing body 120 to a dumping start position P07 and the transport vehicle 200 does not exist under the interference avoidance position P02. The pin of the bucket 113 moves to the load-empty swing start position P01 that is higher than the dumping start position P07 by the dumping control (described later). The avoidance position specifying unit 1215 specifies, for example, a circle centered on the swing center of the swing body 120 and having a radius that is defined by the distance between the swing center and the load-empty swing start position P01, and specifies, among positions on the circle, a position where the outer shape of the bucket 113 does not interfere with the transport vehicle 200 when viewed in a plan view from above and which is closest to the load-empty swing start position P01, as the interference avoidance position P02. The avoidance position specifying unit 1215 can determine whether or not the transport vehicle 200 and the bucket 113 interfere with each other, based on the position of the transport vehicle 200 and the positions of the plurality of points on the contour of the bucket 113. Here, the expressions "same height" and "equal distance" are not necessarily limited to exactly the same height or distance, and some tolerances or margins of error are allowed.

The excavation position specifying unit 1216 specifies a point separated from the excavation point P22, which is included in the automatic excavation and loading instruction, by the distance from the pin of the bucket 113 to the teeth of the bucket 113, as an excavation position P05. That is, in a case where the bucket 113 is in a predetermined excavation posture with the teeth facing the dump direction, the pin of the bucket 113 is located at the excavation position P05 when the teeth of the bucket 113 is located at the excavation point P22.

Further, the excavation position specifying unit 1216 decides a position above the excavation position P05 by a predetermined height, as a swing end position P04.

The lowering stop determination unit 1217 determines whether or not the height of the pin of the bucket 113 is the same as the height of the swing end position P04 when the lowering operation of the work equipment 110 is performed at the same time as the load-empty swing of the swing body 120. The position of the tip of the arm 112 at this time is a lowering stop position P03.

Figure 7:
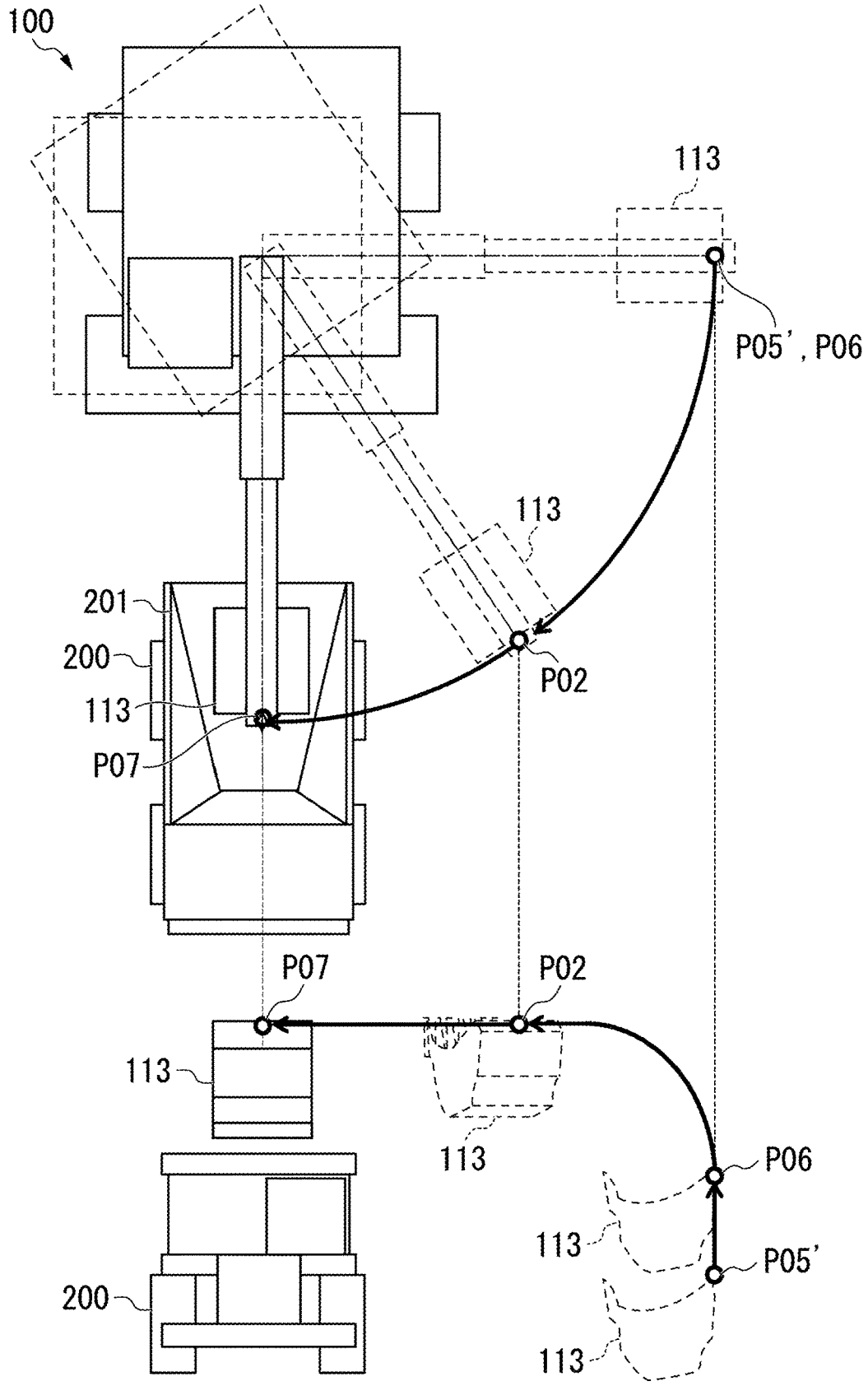
FIG. 7 is a diagram showing an example of a locus of the bucket after excavation in the automatic excavation and loading control according to the first embodiment.

FIG. 7 is a diagram showing an example of the locus of the bucket after the excavation in the automatic excavation and loading control according to the first embodiment.

The start position decision unit 1218 decides the dumping start position P07, based on the position of the dump body 201. Specifically, the start position decision unit 1218 decides the height of the dumping start position P07 to be a height obtained by adding the amount of change in the height of the bucket 113 due to the automatic dumping control obtained in advance, the height of the bucket 113, and a height of a control margin of the bucket 113 to the height of the dump body 201. The height of the bucket 113 is, for example, the height from the ground surface to the lowest point of the bucket 113. The height of the control margin is a margin that is decided according to variation in the height error of the bucket 113 that is caused by a sensor error or a control delay. The moving distance of the lowest point of the bucket 113 by the automatic dumping control will be described later.

Further, the start position decision unit 1218 changes a component in a longitudinal direction of the dump body 201 of the dumping start position P07 according to the number of times of loading into the same transport vehicle 200. Specifically, the start position decision unit 1218 decides the initial dumping start position P07 to be a position on the interior side of the dump body 201 (the front side of the transport vehicle 200), and moves the dumping start position P07 to a position on the exterior side of the dump body 201 (the rear side of the transport vehicle 200) according to an increase in the number of times of loading.

When the instruction receiving unit 1213 receives the excavation and loading instruction, the down swing control unit 1219 generates commands to control the swing body 120, the boom 111, the arm 112, and the bucket 113, in order to move the bucket 113 to the excavation position P05, based on the excavation position P05 and the interference avoidance position P02. That is, the down swing control unit 1219 generates each command such that the bucket 113 arrives at the excavation position P05 from the load-empty swing start position P01 via the interference avoidance position P02, the lowering stop position P03, and the swing end position P04. The down swing means that the swing body 120 is swung while lowering the boom 111 so as to move the bucket 113 from above the dump body 201 to the excavation position.

When the bucket 113 arrives at the excavation position P05, the excavation control unit 1220 generates a command to rotate and move the bucket 113 in the excavation direction.

The hoist swing control unit 1221 generates commands to control the swing body 120, the boom 111, the arm 112, and the bucket 113 in order to move the bucket 113 to the dumping start position P07, based on the dumping start position P07 and the interference avoidance position P02. That is, the hoist swing control unit 1221 generates each command such that the bucket 113 arrives at the dumping start position P07 from an excavation completion position P05' via an on-load swing start position P06 and the interference avoidance position P02. At this time, the hoist swing control unit 1221 generates a command to rotate the bucket 113 such that the height of the bucket 113 does not change even if the boom 111 and the arm 112 are driven. In a case where the dumping start position P07 is lower than the interference avoidance position P02, the hoist swing control unit 1221 outputs only a command to swing the swing body 120 from the interference avoidance position P02, and after the pin of the bucket 113 arrives at the dumping start position P07, outputs a command to lower the boom 111 so as to move the pin of the bucket 113 to the dumping start position P07. The hoist swing control unit 1221 is an example of a dumping position adjusting unit that generates a command to rotate the boom 111 such that the bucket 113 moves to the dumping start position P07. The hoist swing means that the swing body 120 is swung while raising the boom 111 in order to move the bucket 113 holding the earth above the dump body 201.

When the bucket 113 arrives at the dumping start position P07, the dumping control unit 1222 generates commands to control the boom 111, the arm 112, and the bucket 113 in order to rotate the bucket 113 in the dump direction.

Figure 8:
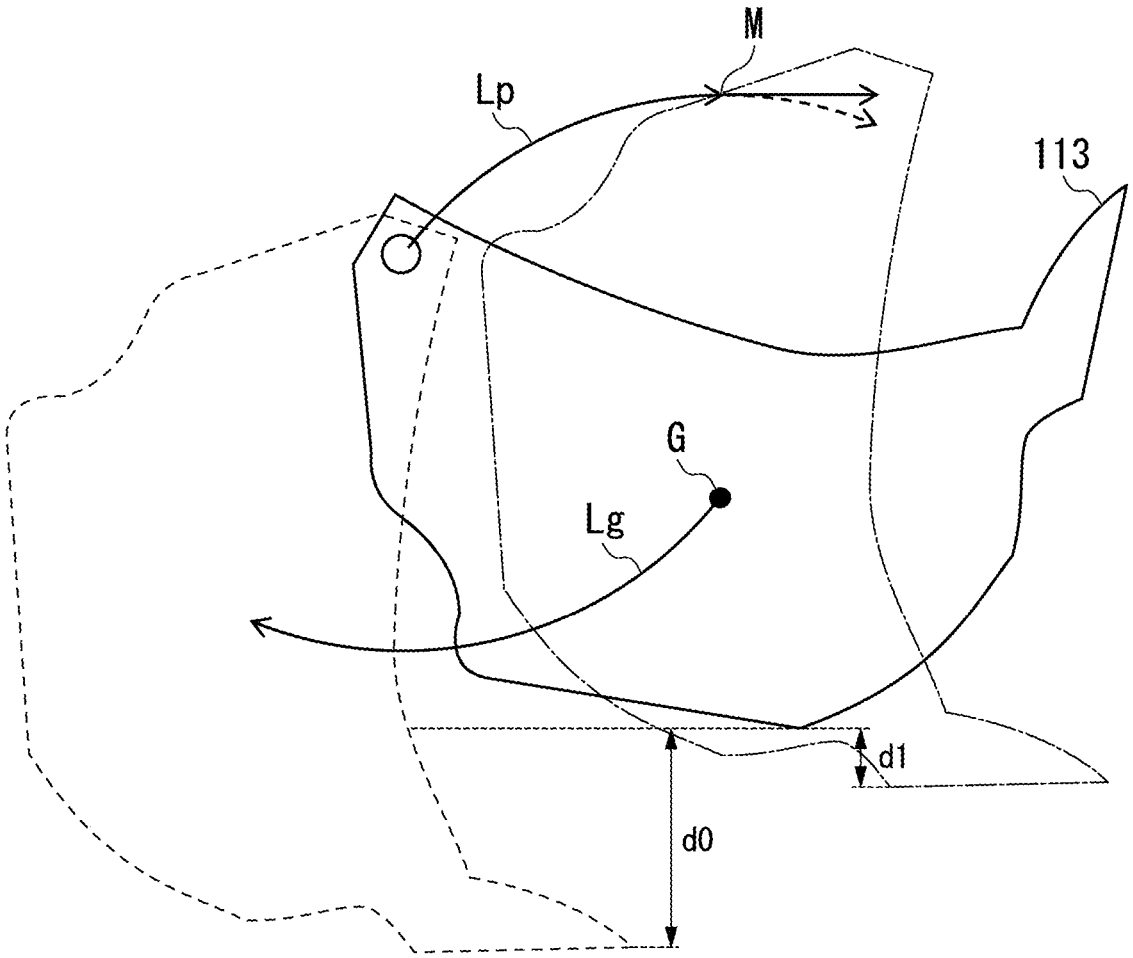
FIG. 8 is a diagram showing an example of a locus of the bucket at the time of dumping in the automatic excavation and loading control according to the first embodiment.

FIG. 8 is a diagram showing an example of the locus of the bucket at the time of the dumping in the automatic excavation and loading control according to the first embodiment.

The dumping control unit 1222 generates each command by the following procedure in order to suppress a fluctuation of the height of the bucket 113. The dumping control unit 1222 generates a command to rotate the bucket 113 in the dump direction until the inclination of the bucket 113 reaches a predetermined dumping completion angle. The dumping control unit 1222 generates commands to drive the boom 111 and the arm 112 such that, for example, the bucket 113 rotates around a geometric center of gravity G of the side surface of the bucket 113 during the rotation of the bucket 113.

A locus Lp of the pin of the bucket 113 at the time of the automatic dumping control by the dumping control unit 1222 is obtained in advance by calculation. The dumping control unit 1222 generates commands to drive the boom 111 and the arm 112 such that the pin of the bucket 113 moves along the locus Lp.

A locus Lg of the geometric center of gravity G of the bucket 113 when the bucket 113 is rotated in the dump direction until the absolute angle of the bucket 113 reaches the dumping completion angle can be obtained in advance by calculation. In FIG. 8, the position and inclination of the bucket 113 at the time of start of dumping are represented by the bucket 113 drawn by a solid line. Further, the position and inclination of the bucket 113 when the bucket 113 is rotated while keeping the position of the pin of the bucket 113 constant is represented by the bucket 113 drawn by a broken line. The absolute angle of the bucket 113 is, for example, an angle of the bucket 113 with respect to the axis in a vehicle body coordinate system or the site coordinate system. By rotating the locus Lg by 180 degrees and aligning a starting point with the pin of the bucket 113, it is possible to obtain the locus Lp of the pin of the bucket 113 for keeping the position of the geometric center of gravity G constant. In FIG. 8, the position and inclination of the bucket 113 when the bucket 113 is rotated while moving the pin of the bucket 113 according to the locus Lp are represented by the bucket 113 drawn by a dashed-dotted line. As shown in FIG. 8, in a case where the locus in which the locus Lg is inverted has a maximum point M, that is, in a case where the locus in which the locus Lg is inverted descends from the middle, the locus Lp of the pin of the bucket 113 is set to move in the horizontal direction from the maximum point M. The locus in which the locus Lg is inverted is represented by a broken line arrow in FIG. 8. This is for preventing the behavior of the work equipment 110 from becoming unstable due to the driving direction of the boom 111 being switched from the raising direction to the lowering direction with the maximum point as a boundary.

As shown in FIG. 8, the locus Lp of the pin moves in the upward direction and the front direction of the bucket 113. Therefore, the dumping control unit 1222 outputs a command to rotate the boom 111 in the raising direction during a period until the inclination of the bucket 113 reaches the dumping completion angle from the inclination at the time of start of the automatic dumping control. Further, the dumping control unit 1222 outputs a command to rotate the arm 112 in a pulling direction during a period until the inclination of the bucket 113 reaches the dumping completion angle from an inclination at the time of start of the automatic dumping control.

As shown in FIG. 8, a moving distance dl of the lowest point of the bucket 113 when the bucket 113 is rotated while the pin of the bucket 113 is moved along the locus Lp becomes smaller than a moving distance d0 when the bucket 113 is rotated with the pin of the bucket 113 as the center. In this manner, the moving distance dl of the lowest point of the bucket 113 by the automatic dumping control can be obtained in advance.

Figure 9:
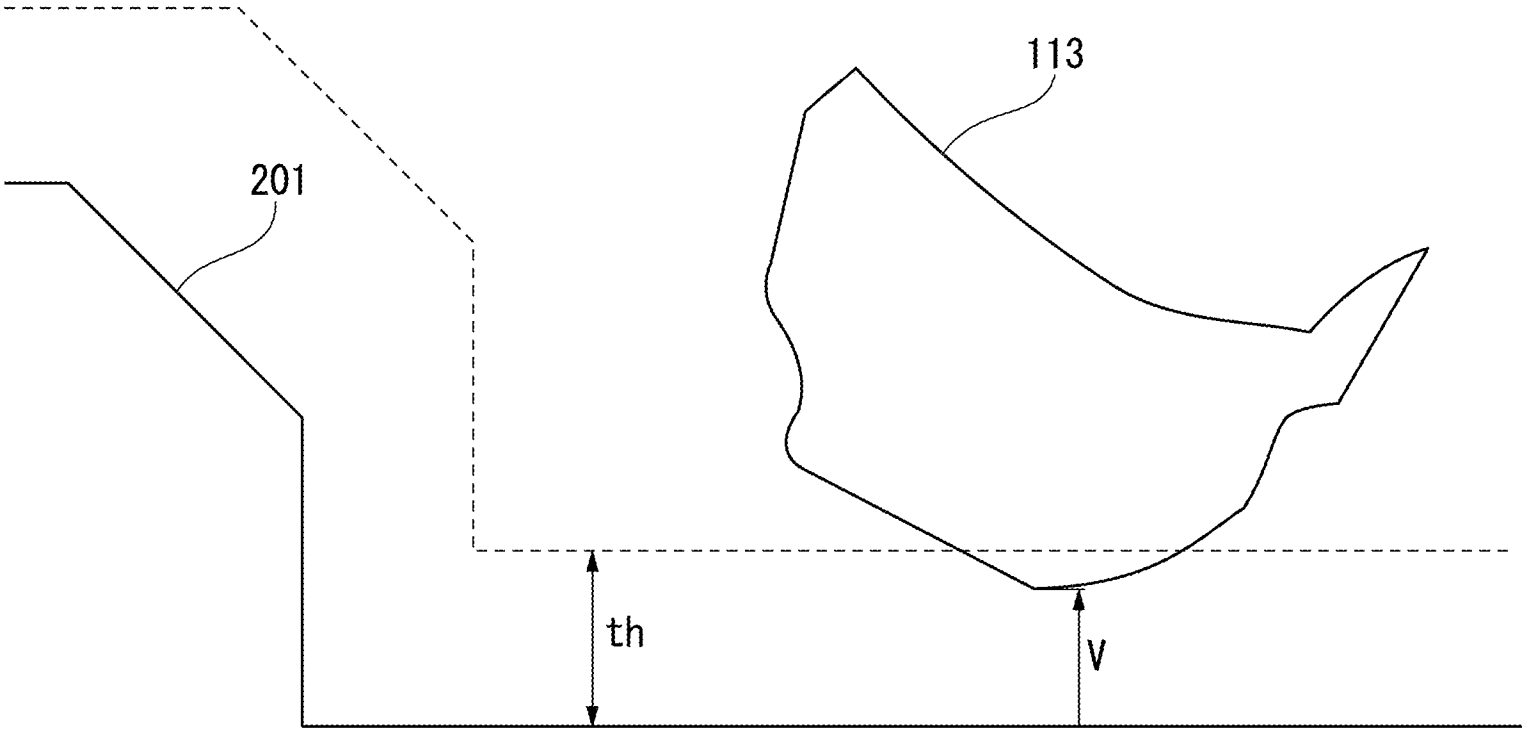
FIG. 9 is a diagram showing a first example of avoidance control according to the first embodiment.
Figure 10:
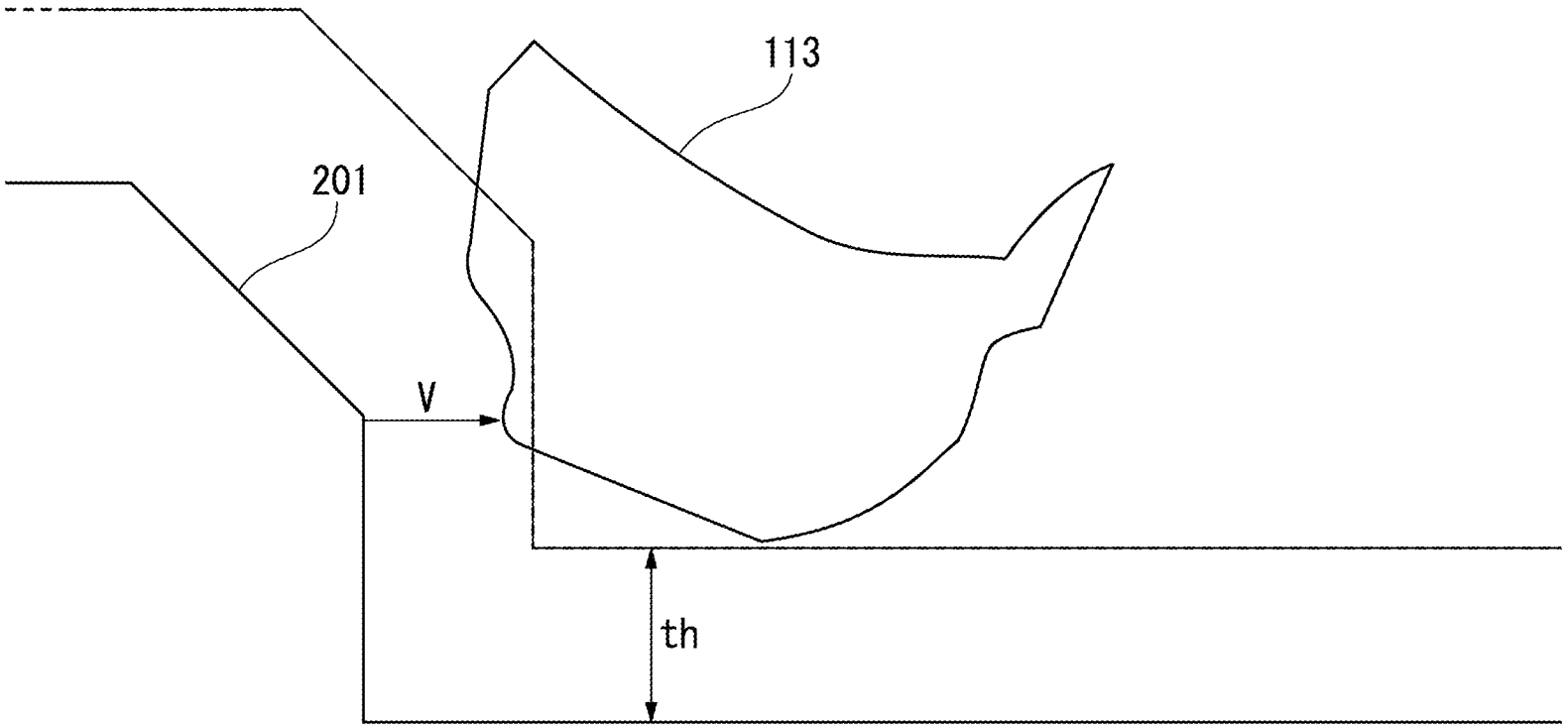
FIG. 10 is a diagram showing a second example of the avoidance control according to the first embodiment.

FIGS. 9 and 10 are diagrams showing an example of the avoidance control according to the first embodiment.

In a case where the distance between the bucket 113 and the dump body 201 is within a predetermined proximity threshold value th, the avoidance control unit 1223 generates a command to rotate the boom 111 in the raising direction or a command to rotate the arm 112 in the pulling direction and stops the output of a command to drive the bucket 113. Specifically, the avoidance control unit 1223 generates a command to drive the boom 111 or the arm 112 so as to move the bucket 113 in an extending direction of a line segment V connecting the dump body 201 and the bucket 113 at the shortest distance. For example, as shown in FIG. 9, in a case where the distance between the bottom surface of the dump body 201 and the bucket 113 is the shortest, the avoidance control unit 1223 drives the boom 111 such that the bucket 113 moves in the upward direction in which the line segment V connecting the dump body 201 and the bucket 113 at the shortest distance extends. As shown in FIG. 10, in a case where the distance between a front panel portion of the dump body 201 and the bucket 113 is the shortest, the avoidance control unit 1223 drives the arm 112 such that the bucket 113 moves in the rearward direction in which the line segment V connecting the dump body 201 and the bucket 113 at the shortest distance extends. The avoidance control unit 1223 may output a command to stop the driving of the bucket 113 instead of stopping the output of the command to drive the bucket 113. In another embodiment, the avoidance control unit 1223 may drive the boom 111 such that the bucket 113 moves in the upward direction in a case where the distance between a side gate portion of the dump body 201 and the bucket 113 is the shortest.

The command output unit 1224 outputs various commands.

<<Automatic Excavation and Loading Control>>

Figure 11:
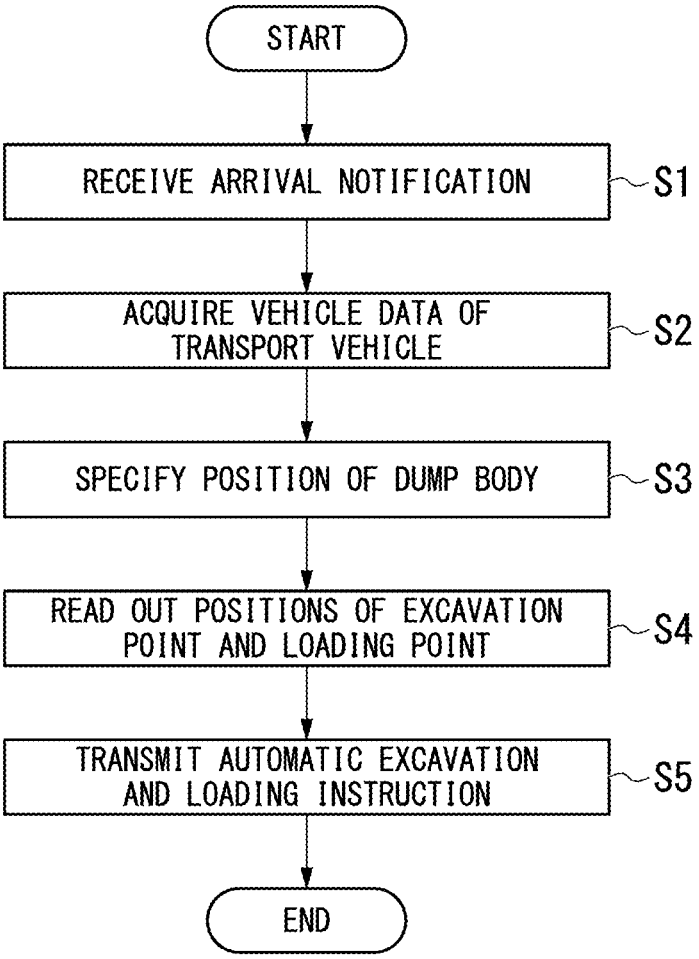
FIG. 11 is a flowchart showing a method of outputting an automatic excavation and loading instruction by the controlling gear according to the first embodiment.

FIG. 11 is a flowchart showing a method of outputting an automatic excavation and loading instruction by the controlling gear according to the first embodiment.

When the notification receiving unit 314 of the controlling gear 300 receives the arrival notification at the loading point P3 from the transport vehicle 200 (step S1), the dump body specifying unit 315 acquires the vehicle data from the transport vehicle 200 (step S2). The dump body specifying unit 315 specifies the position of the dump body 201 in the site coordinate system, based on the acquired vehicle data (step S3). The dump body specifying unit 315 transmits the specified position of the dump body 201 to the work machine 100.

The automatic excavation and loading instruction unit 316 reads out the positions of the excavation point P22 and the loading point P3 from the control position storage unit 351 (step S4). The automatic excavation and loading instruction unit 316 transmits an automatic excavation and loading instruction including the read positions of the excavation point P22 and the loading point P3 to the work machine 100 (step S5).

Figure 12:
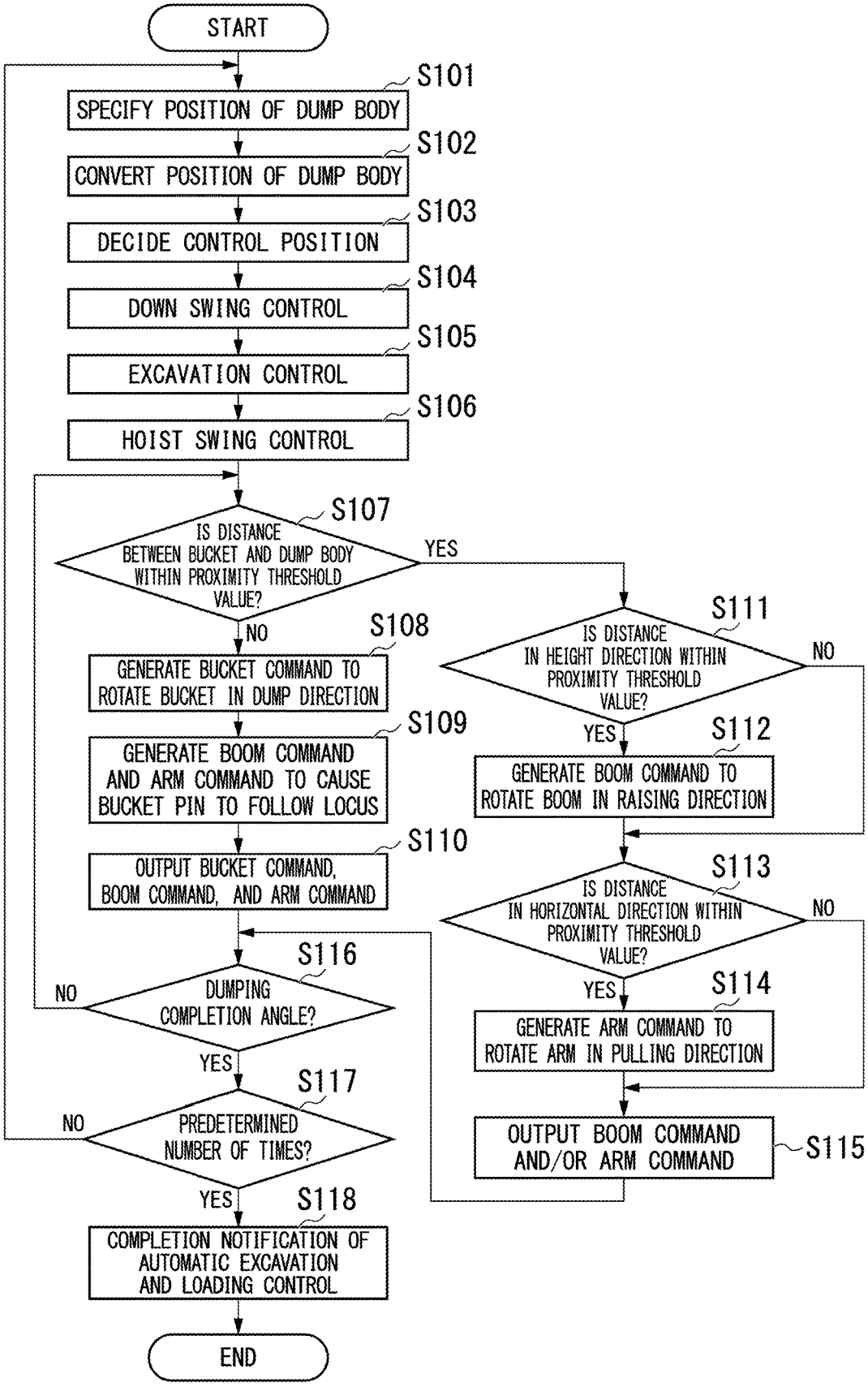
FIG. 12 is a flowchart showing the automatic excavation and loading control by the work machine according to the first embodiment.

FIG. 12 is a flowchart showing the automatic excavation and loading control by the work machine according to the first embodiment.

When the instruction receiving unit 1213 of the control device 125 receives the input of the automatic excavation and loading instruction from the controlling gear 300, the automatic excavation and loading control shown in FIG. 12 is executed. During the automatic excavation and loading control, the vehicle data acquisition unit 1211 acquires the position and azimuth direction of the swing body 120, the inclination angles of the boom 111, the arm 112, and the bucket 113, and the posture of the swing body 120 at regular intervals.

The coordinate conversion unit 1214 acquires the position of the dump body 201 in the site coordinate system from the controlling gear 300 (step S101). The coordinate conversion unit 1214 converts the position of the dump body 201 from the site coordinate system to the machine coordinate system, based on the position, azimuth direction, and posture of the swing body 120 acquired by the vehicle data acquisition unit 1211 (step S102).

The bucket specifying unit 1212, the avoidance position specifying unit 1215, the excavation position specifying unit 1216, and the start position decision unit 1218 respectively decide the load-empty swing start position P01, the interference avoidance position P02, the swing end position P04, and the dumping start position P07 (step S103).

The down swing control unit 1219 generates commands to drive the swing body 120, the boom 111, the arm 112, and the bucket 113 such that the bucket 113 arrives at the excavation position P05, based on each control position decided in step S103. The command output unit 1224 outputs each of the generated commands (step S104).

When the bucket 113 arrives at the excavation position P05, the excavation control unit 1220 generates commands to drive the arm 112 and the bucket 113 in order to rotate and move the bucket 113 in the excavation direction. The command output unit 1224 outputs each of the generated commands (step S105).

When the excavation control in step S105 is ended, the hoist swing control unit 1221 generates commands to control the swing body 120, the boom 111, the arm 112, and the bucket 113 in order to move the bucket 113 to the dumping start position P07, based on each control position decided in step S103. The command output unit 1224 outputs each of the generated commands (step S106).

When the bucket 113 arrives at the dumping start position P07, the avoidance control unit 1223 determines whether or not the distance between the bucket 113 and the dump body 201 is within a predetermined proximity threshold value (step S107). When the distance between the bucket 113 and the dump body 201 is not within the predetermined proximity threshold value (step S107: NO), the dumping control unit 1222 generates a command to rotate the bucket 113 in the dump direction at a constant angular velocity (step S108). The dumping control unit 1222 generates commands to drive the boom 111 and the arm 112 by PID control based on the position of the pin of the bucket 113 and the locus Lp (step S109). That is, the dumping control unit 1222 generates a command to rotate the boom 111 in the raising direction and a command to rotate the arm 112 in the pulling direction. The command output unit 1224 outputs the command generated in step S108 and the command generated in step S109 (step S110).

In a case where the distance between the bucket 113 and the dump body 201 is within the predetermined proximity threshold value (step S107: YES), the avoidance control unit 1223 determines whether or not the distance between the bucket 113 and the dump body 201 in the height direction is within the predetermined proximity threshold value (step S111). In a case where the distance between the bucket 113 and the dump body 201 is within the proximity threshold value in the height direction (step S111: YES), the avoidance control unit 1223 generates a command to rotate the boom 111 in the raising direction (step S112). The avoidance control unit 1223 determines whether or not the distance between the bucket 113 and the dump body 201 in the horizontal direction is within the predetermined proximity threshold value (step S113). In a case where the distance between the bucket 113 and the dump body 201 is within the proximity threshold value in the horizontal direction (step S113: YES), the avoidance control unit 1223 generates a command to rotate the arm 112 in the pulling direction (step S114). The command output unit 1224 outputs at least one of the command generated in step S107 and the command generated in step S108 (step S115). At this time, the command output unit 1224 does not output a command to rotate the bucket 113.

The dumping control unit 1222 determines whether or not the inclination of the bucket 113 has reached the dumping completion angle (step S116). In a case where the inclination of the bucket 113 has not reached the dumping completion angle (step S116: NO), the control device 125 returns the processing to step S107 and continues the dumping control. In a case where the inclination of the bucket 113 has reached the dumping completion angle (step S116: YES), the dumping control unit 1222 determines whether or not the number of times of loading into the same transport vehicle 200 has reached a predetermined number of times (step S117). In a case where the number of times of loading into the same transport vehicle 200 has not reached the predetermined number of times (step S117: NO), the processing is returned to step S101 and the control device 125 executes the automatic excavation and loading control again. In a case where the number of times of loading into the same transport vehicle 200 has reached the predetermined number of times (step S117: YES), the dumping control unit 1222 transmits a completion notification of the automatic excavation and loading control to the controlling gear 300 (step S118), and the processing is ended.

In this manner, in the work machine 100 according to the first embodiment, in a case where it is determined to start the automatic dumping control, the control device 125 generates a command to rotate the bucket 113 in the dump direction until the inclination of the bucket 113 reaches the dumping completion angle, and generates a command to rotate the boom 111 in the raising direction during a period until the inclination of the bucket 113 reaches the dumping completion angle from the inclination at the time of start of the automatic dumping control. That is, since the lowering of the height of the bucket 113 can be canceled out by the raising processing of the boom 111, a fluctuation in the height of the bucket 113 can be reduced. The smaller the dump body 201 of the transport vehicle 200 with respect to the bucket 113, the smaller the locus of the bucket 113, and therefore the effect of reducing the fluctuation in the height of the bucket 113 can be enhanced.

Further, the control device 125 according to the first embodiment generates a command to rotate the arm 112 in the pulling direction during a period until the inclination of the bucket 113 reaches the dumping completion angle from the inclination at the time of start of the automatic dumping control. In this way, it is possible to reduce variation in a point of fall of the excavation object.

When the bucket 113 is rotated in the dump direction without moving the arm 112, the position in the horizontal direction of the teeth of the bucket 113 moves in association with the rotation. By rotating the arm 112 in the pulling direction while the bucket 113 is rotating in the dump direction, it is possible to cancel out the movement in the horizontal direction of the teeth of the bucket 113. The control device 125 according to another embodiment may move the boom 111 in the raising direction and may not move the arm 112.

Further, the control device 125 according to the first embodiment generates the command such that the amount of movement of the geometric center of gravity G of the side surface of the bucket 113 is reduced compared to a case where the boom 111 and the arm 112 are not controlled. In other embodiments, there is no limitation to this. For example, the control device 125 according to another embodiment may generate the command such that the amount of movement of the center point of a circumscribed circle that is in contact with the contour of the side surface of the bucket 113 is reduced. When the control device 125 generates the command such that the amount of movement of a point inside a circle whose diameter is a line segment connecting the teeth and the pin of the bucket 113 is reduced, it is possible to appropriately reduce the amount of movement of the bucket 113.

Further, the control device 125 according to the first embodiment generates a command to rotate the boom 111 in the raising direction or a command to rotate the arm 112 in the pulling direction and stops the output of a command to drive the bucket 113, in a case where the distance between the contour of the bucket 113 and the dump body 201 is within the proximity threshold value. In this way, even in a case where a disturbance such as rattling of the scaffolding of the work machine 100 occurs, it is possible to reduce the possibility of contact between the bucket 113 and the dump body 201.

Further, according to the first embodiment, the position in the horizontal direction of the dumping start position differs according to the number of times of the automatic dumping control to the same transport vehicle 200. In this way, it is possible to avoid the concentration of the dumping position to the transport vehicle 200 and prevent the excavation object from spilling from the dump body 201.

Other Embodiments

The embodiment have been described above in detail with reference to the drawings; however, the specific configurations are not limited to the above-described configurations, and various design changes and the like can be made. In another embodiment, the order of the above-described processes may be appropriately changed. In addition, some of the processes may be executed in parallel.

In the embodiment described above, the operation of the work machine 100 is automatically controlled by the controlling gear 300, but there is no limitation to this. For example, the work machine 100 according to another embodiment may be operated by an operator. In this case, the operator may output an automatic excavation and loading instruction to the control device 125 by pressing an automatic excavation and loading button (not shown) provided at a driver's seat. Further, in another embodiment, the work machine 100 may transmit and receive signals by using inter-vehicle communication instead of communication via an access point.

The control device 125 according to the embodiment described above may be formed of a single computer, or the configurations of the control device 125 may be divided into a plurality of computers, and the plurality of computers may cooperate with each other to function as the control device 125. At this time, some of configurations forming the control device 125 may be realized by the controlling gear 300.

The control system can suppress lowering of the lowest point of the bucket in the automatic dumping control.

The invention claimed is:

1. A control system for a work machine that includes a work machine main body, a boom rotatably mounted to the work machine main body, an arm rotatably mounted to a tip of the boom, and a bucket rotatably mounted to a tip of the arm, the control system comprising:

an automatic control determination unit configured to determine whether to start automatic dumping control; and a dumping control unit configured to generate a first command to rotate the bucket in a dump direction until an inclination of the bucket reaches a predetermined dumping completion angle upon determining to start the automatic dumping control, and generate a second command to rotate the boom in a raising direction during a period until the inclination of the bucket reaches the dumping completion angle from an inclination at the time of start of the automatic dumping control.

2. The control system according to claim 1, wherein the dumping control unit generates a third command to rotate the arm in one direction during a period until the inclination of the bucket reaches the dumping completion angle from the inclination at the time of start of the automatic dumping control.

3. The control system according to claim 2, wherein the dumping control unit generates the second command such that an amount of movement of a reference point is reduced, the reference point being a point inside a circle whose diameter is a line segment connecting a pin that connects the arm and the bucket and teeth of the bucket.

4. The control system according to claim 3, wherein the reference point is a geometric center of gravity of a side surface of the bucket.

5. The control system according to claim 4, further comprising a dump body specifying unit configured to specify a position of a dump body;

a bucket specifying unit configured to specify a position of a contour of the bucket when the bucket is viewed from a side; and an avoidance control unit configured to generate a fourth command to rotate the boom in the raising direction or a fifth command to rotate the arm in one direction and stop output of the first command, upon determining a distance between the contour of the bucket when the bucket is viewed from the side and the dump body is within a predetermined proximity threshold value.

6. The control system according to claim 5, further comprising a dumping position adjusting unit configured to generate a sixth command to rotate the boom such that the bucket moves to a dumping start position higher than a height of the dump body by an amount equal to or larger than an amount of change in a height of the bucket due to the automatic dumping control upon determining to start the automatic dumping control, the dumping control unit generating the first command after a lowest point of the bucket is moved to the dumping start position.

7. The control system according to claim 6, wherein the dumping position adjusting unit adjusts a position in a horizontal direction of the dump body of the dumping start position according to the number of times of the automatic dumping control to the same dump body.

8. The control system according to claim 1, wherein the dumping control unit generates the second command such that an amount of movement of a reference point is reduced, the reference point being a point inside a circle whose diameter is a line segment connecting a pin that connects the arm and the bucket and teeth of the bucket.

9. The control system according to claim 8, wherein the reference point is a geometric center of gravity of a side surface of the bucket.

10. The control system according to claim 1, further comprising a dump body specifying unit configured to specify a position of a dump body;

a bucket specifying unit configured to specify a position of a contour of the bucket when the bucket is viewed from a side; and an avoidance control unit configured to generate a fourth command to rotate the boom in the raising direction or a fifth command to rotate the arm in one direction and stop output of the first command, upon determining a distance between the contour of the bucket when the bucket is viewed from the side and the dump body is within a predetermined proximity threshold value.

11. The control system according to claim 1, further comprising a dumping position adjusting unit configured to generate a sixth command to rotate the boom such that the bucket moves to a dumping start position higher than a height of the dump body by an amount equal to or larger than an amount of change in a height of the bucket due to the automatic dumping control upon determining to start the automatic dumping control, the dumping control unit generating the first command after a lowest point of the bucket is moved to the dumping start position.

12. The control system according to claim 11, wherein the dumping position adjusting unit adjusts a position in a horizontal direction of the dump body of the dumping start position according to the number of times of the automatic dumping control to the same dump body.

13. A control method for a work machine that includes a work machine main body, a boom rotatably mounted to the work machine main body, an arm rotatably mounted to a tip of the boom, and a bucket rotatably mounted to a tip of the arm, the control method comprising:

determining whether to start automatic dumping control;

generating a first command to rotate the bucket in a dump direction until an inclination of the bucket reaches a predetermined dumping completion angle upon determining to start the automatic dumping control; and generating a second command to rotate the boom in a raising direction during a period until the inclination of the bucket reaches the dumping completion angle from an inclination at the time of start of the automatic dumping control according to the first command.

* * * * *